US012768358B2

(12) United States Patent
Quan et al.

(10) Patent No.: US 12,768,358 B2
(45) Date of Patent: Oct. 20, 2026

(54) SCALABLE MULTI-STAGE MAGNETIC LEVITATION MOLTEN SALT PUMP

(71) Applicants: Wenzhou Pump and Valve Engineering Research Institute of Lanzhou University of Technology, Wenzhou (CN); Lanzhou University of Technology, Lanzhou (CN)

(72) Inventors: Hui Quan, Wenzhou (CN); Donglin Ma, Wenzhou (CN); Yuanying Du, Lanzhou (CN); Weizheng Zhang, Wenzhou (CN); Ying Guo, Lanzhou (CN)

(73) Assignees: Wenzhou Pump and Valve Engineering Research Institute of Lanzhou University of Technology, Wenzhou (CN); Lanzhou University of Technology, Lanzhou (CN)

( * ) Notice: Subject to any disclaimer, the term of this patent is extended or adjusted under 35 U.S.C. 154(b) by 0 days.

(21) Appl. No.: 19/411,411

(22) Filed: Dec. 8, 2025

(65) Prior Publication Data

US 2026/0298245 A1 Oct. 1, 2026

(30) Foreign Application Priority Data

Mar. 26, 2025 (CN) ..... 202510363793.1

(51) Int. Cl.
*F04D 7/00* (2006.01)
*F04D 7/06* (2006.01)
(Continued)

(52) U.S. Cl.
CPC ..... *F04D 7/00* (2013.01); *F04D 7/06* (2013.01); *F04D 13/026* (2013.01);
(Continued)

(58) Field of Classification Search
CPC .. F04D 29/048; F04D 13/0633; F04D 13/064; F04D 29/058; F04D 7/06;
(Continued)

(56) References Cited

U.S. PATENT DOCUMENTS 12,040,685 B2 * 7/2024 Morello ..... H02K 7/09
2010/0232984 A1 * 9/2010 Bade ..... F04D 29/584 417/372

(Continued)

FOREIGN PATENT DOCUMENTS

CN 110730867 A 1/2020
CN 212803628 U 3/2021

(Continued)

OTHER PUBLICATIONS

Jianjun Gu, Brief Discussion on Gap Control of Multistage Pump Balancing Devices, Chemical Management, 2019, pp. 163-165, vol. 26.

*Primary Examiner* — Dominick L Plakkoottam
(74) *Attorney, Agent, or Firm* — Bayramoglu Law Offices LLC

(57) ABSTRACT

A scalable multi-stage magnetic levitation molten salt pump is provided. The scalable multi-stage magnetic levitation molten salt pump includes: a first pump stage assembly, a second pump stage assembly, and a third pump stage assembly, which are arranged in fluid communication sequentially between a suction interface and a pressure interface of the molten salt pump, a radial magnetic levitation bearing assembly, which is disposed between the first pump stage assembly and the second pump stage assembly, configured to provide rotational support to a rotor; and an axial magnetic levitation bearing, which is disposed between the second pump stage assembly and the third pump stage assembly, configured to provide axial support to the rotor. The axial magnetic levitation bearing is separated from the
(Continued)

radial magnetic levitation bearings, such that the configuration facilitates maintenance of the axial magnetic levitation bearing, reduces maintenance costs, and enhances the long-term reliability of the pump.

7 Claims, 3 Drawing Sheets

(51) Int. Cl.

| | |
|---|---|
| ***F04D 13/02*** | (2006.01) |
| ***F04D 13/06*** | (2006.01) |
| ***F04D 29/046*** | (2006.01) |
| ***F04D 29/70*** | (2006.01) |

(52) U.S. Cl.
CPC ..... *F04D 13/027* (2013.01); *F04D 13/06* (2013.01); *F04D 13/0633* (2013.01); *F04D 29/046* (2013.01); *F04D 29/708* (2013.01)

(58) Field of Classification Search
CPC ..... F04D 25/06; F04D 7/00; F04D 13/026; F04D 13/027; F04D 13/06; F04D 29/046; F04D 29/708
See application file for complete search history.

(56) References Cited

U.S. PATENT DOCUMENTS

| | | | | |
|---|---|---|---|---|
| 2011/0052432 | A1* | 3/2011 | Cunningham | F04D 29/048 417/423.12 |
| 2014/0227079 | A1* | 8/2014 | Gilarranz | F04D 25/0686 415/124.2 |
| 2019/0074749 | A1* | 3/2019 | Snell | H02K 5/203 |
| 2020/0158117 | A1* | 5/2020 | Shi | F16C 32/0489 |
| 2021/0048029 | A1 | 2/2021 | Ye et al. | |
| 2021/0115929 | A1* | 4/2021 | Nakazawa | F04D 29/051 |
| 2022/0178381 | A1 | 6/2022 | De Raeve et al. | |
| 2023/0246534 | A1* | 8/2023 | Stubsgaard | F04D 13/0606 310/201 |
| 2025/0377016 | A1* | 12/2025 | Fujimoto | F16C 32/0444 |

FOREIGN PATENT DOCUMENTS

| | | | | | |
|---|---|---|---|---|---|
| CN | 113202780 | A | * | 8/2021 | F04D 29/086 |
| CN | 214998262 | U | * | 12/2021 | |
| CN | 117748818 | A | * | 3/2024 | F04D 29/048 |
| DE | 202016102351 | U1 | | 5/2016 | |
| EP | 3726077 | A1 | | 10/2020 | |

* cited by examiner

SCALABLE MULTI-STAGE MAGNETIC LEVITATION MOLTEN SALT PUMP

CROSS REFERENCE TO THE RELATED APPLICATIONS

This application is based upon and claims priority to Chinese Patent Application No. 202510363793.1, filed on Mar. 26, 2025, the entire contents of which are incorporated herein by reference.

TECHNICAL FIELD

The present invention relates to the technical field of fluid machinery, and more particularly to a scalable multi-stage magnetic levitation molten salt pump.

BACKGROUND

Conventional centrifugal pumps operating under extreme conditions, such as high temperatures and high corrosivity, often encounter challenges, including insufficient bearing lubrication and severe mechanical wear. These challenges make achieving both high operational efficiency and long service life difficult. Magnetic levitation technology achieves stable rotation with minimized friction and eliminated lubrication requirements in extreme environments due to non-contact support characteristic, and is capable of mitigating vibration to a certain extent, thereby offering significant operational advantages.

However, currently, in the fields of solar thermal power generation, nuclear energy systems, and molten salt energy storage, the molten salt pump serves as the core power equipment. Issues such as the overall structural design, axial force balancing strategy, and multi-stage impeller coupling have not been adequately addressed, leading to frequent maintenance requirements and difficulties in ensuring long-term stable operation. Furthermore, due to the high-temperature characteristics of molten salt, the rotor is susceptible to thermal deformation (variation in deflection) and stress effects during long-term operation, which may lead to rotor binding/seizure and thereby further increase maintenance burdens.

SUMMARY

To solve the foregoing problems, the present invention adopts the following technical solution.

A scalable multi-stage magnetic levitation molten salt pump, wherein a first pump stage assembly, a second pump stage assembly, and a third pump stage assembly are arranged in fluid communication sequentially between a suction interface and a pressure interface of the molten salt pump;

a radial magnetic levitation bearing assembly, wherein the radial magnetic levitation bearing assembly is disposed between the first pump stage assembly and the second pump stage assembly, configured to provide rotational support to a rotor;

an axial magnetic levitation bearing, wherein the axial magnetic levitation bearing is disposed between the second pump stage assembly and the third pump stage assembly, configured to provide axial support to the rotor;

wherein the radial magnetic levitation bearing assembly and the axial magnetic levitation bearing are respectively enclosed by separate streamlined bearing housings, the streamlined bearing housings are connected to a pump body via guide vanes to form a flow channel.

Further, the first pump stage assembly, the second pump stage assembly, and the third pump stage assembly each include a plurality of pump stages, the first pump stage assembly and the third pump stage assembly each include N pump stages, the second pump stage assembly includes N pump stages, N+1 pump stages, or N+2 pump stages, each pump stage includes an impeller and a casing surrounding the impeller, wherein the impellers are mounted on the rotor, and $N \geq 1$.

Further, the radial magnetic levitation bearing assembly includes:

a radial magnetic levitation bearing outer housing, wherein a first end of the radial magnetic levitation bearing outer housing is connected to a housing of the first pump stage assembly, and a second end is connected to a housing of the second pump stage assembly;

a radial magnetic levitation bearing inner housing, wherein the radial magnetic levitation bearing inner housing is a streamlined bearing housing, and the radial magnetic levitation bearing inner housing is fixedly connected to the radial magnetic levitation bearing outer housing via a guide vane assembly;

an electric motor, wherein a stator of the electric motor is fixed within an interior of the radial magnetic levitation bearing inner housing;

a lower radial magnetic levitation bearing, wherein the lower radial magnetic levitation bearing is disposed within the interior of the radial magnetic levitation bearing inner housing and located on a side of the motor adjacent to the suction interface, and a gap is maintained between the lower radial magnetic levitation bearing and the rotor; and an upper radial magnetic levitation bearing, wherein the upper radial magnetic levitation bearing is disposed within the interior of the radial magnetic levitation bearing inner housing and located on a side of the motor distal from the suction interface, and a gap is maintained between the upper radial magnetic levitation bearing and the rotor.

Further, electromagnetic coils on the stator of the radial magnetic levitation bearing are arranged in two layers, wherein the electromagnetic coils of the two layers are staggered circumferentially.

Further, each layer includes an eight-pole electromagnetic coil.

Further, the axial magnetic levitation bearing includes:

an axial magnetic levitation bearing outer housing, wherein a first end of the axial magnetic levitation bearing outer housing is connected to the housing of the second pump stage assembly, and a second end of the axial magnetic levitation bearing outer housing is connected to a housing of the third pump stage assembly; and an axial magnetic levitation bearing inner housing, wherein the radial magnetic levitation bearing inner housing is a streamlined bearing housing, the axial magnetic levitation bearing inner housing is fixedly connected to the radial magnetic levitation bearing outer housing via a guide vane assembly, and a gap is maintained between the axial magnetic levitation bearing inner housing and the rotor.

Further, an inductive displacement sensor is disposed in each of the gap between the lower radial magnetic levitation bearing and the rotor, the gap between the upper radial magnetic levitation bearing and the rotor, and the gap between the axial magnetic levitation bearing inner housing and the rotor.

Further, the suction interface is provided with an inlet filter screen.

Beneficial Effects: The present invention employs magnetic levitation bearing technology to achieve non-contact support of the rotor. A multi-stage impeller is incorporated, being adapted for conveying high-temperature molten salt, thereby providing high efficiency and stable operational capability. Furthermore, the number of three sets of multi-stage impellers may be increased based on the head requirement, thereby further enhancing pump performance and expanding the range of application scenarios.

According to the present invention, the unique structural interaction within the flow channel formed by the different pump stage assemblies and guide vanes, in conjunction with the magnetic levitation bearing housing, effectively enhances hydraulic efficiency and operational stability of the unit.

According to the present invention, by positioning the axial magnetic levitation bearing between the second pump stage assembly and the third pump stage assembly, the axial magnetic levitation bearing is placed on the side with a higher axial load, more effectively counteracting the axial force generated by the fluid dynamics. Coaxially arranged electromagnetic coils generate an axial force at an end portion of the rotor to prevent axial displacement or collision of the rotor during high-speed rotation, thereby ensuring force equilibrium and enhancing system stability.

The present invention separates the axial magnetic levitation bearing from the radial magnetic levitation bearings, such that the configuration facilitates maintenance of the axial magnetic levitation bearing, reduces maintenance costs, and enhances the long-term reliability of the pump, thereby solving the technical problems in the prior art where the axial magnetic levitation bearing, positioned between two radial magnetic levitation bearings, is subjected to high axial loads. Furthermore, the prior art configuration, lacking separation between the axial magnetic levitation bearing and radial magnetic levitation bearing, results in greater difficulty in maintenance and higher maintenance costs.

Figure 1:
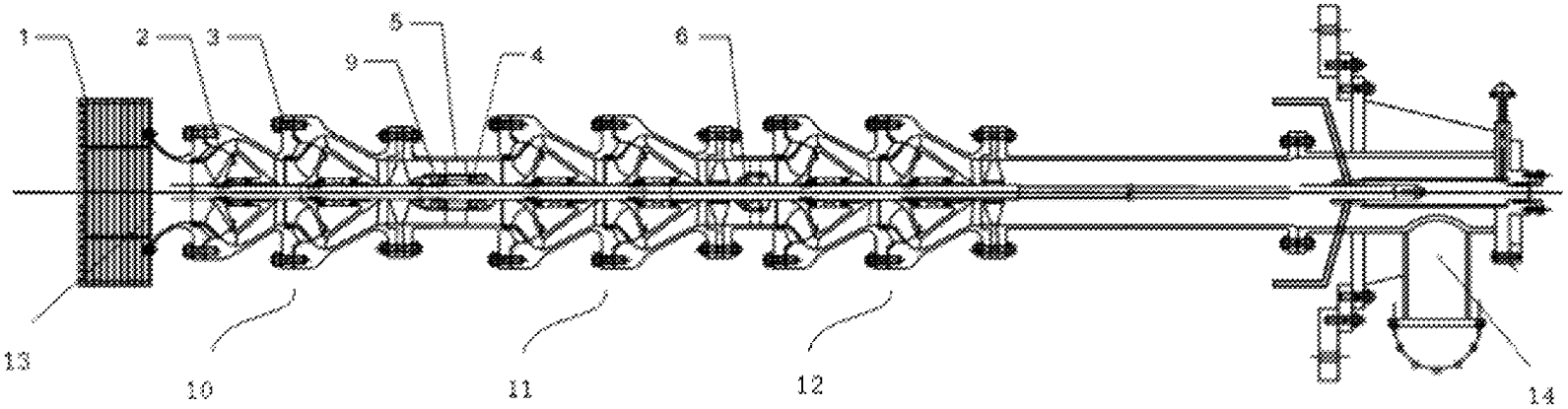
FIG. 1 is a schematic view of an overall structure according to the present invention.

In the drawings, 1. inlet filter screen; 2. impeller; 3. connecting bolt; 4. upper radial magnetic levitation bearing; 5. guide vane assembly; 6. axial magnetic levitation bearing outer housing; 7. rotor; 8. electric motor; 9. lower radial magnetic levitation bearing; 10. first pump stage assembly; 11. second pump stage assembly; 12. third pump stage assembly; 13. suction interface; 14. pressure interface; 15. radial magnetic levitation bearing inner housing; 16. radial magnetic levitation bearing outer housing; 17. axial magnetic levitation bearing inner housing; and 18. axial magnetic levitation bearing outer housing.

DETAILED DESCRIPTION OF THE EMBODIMENTS

Embodiment 1

Figure 2:
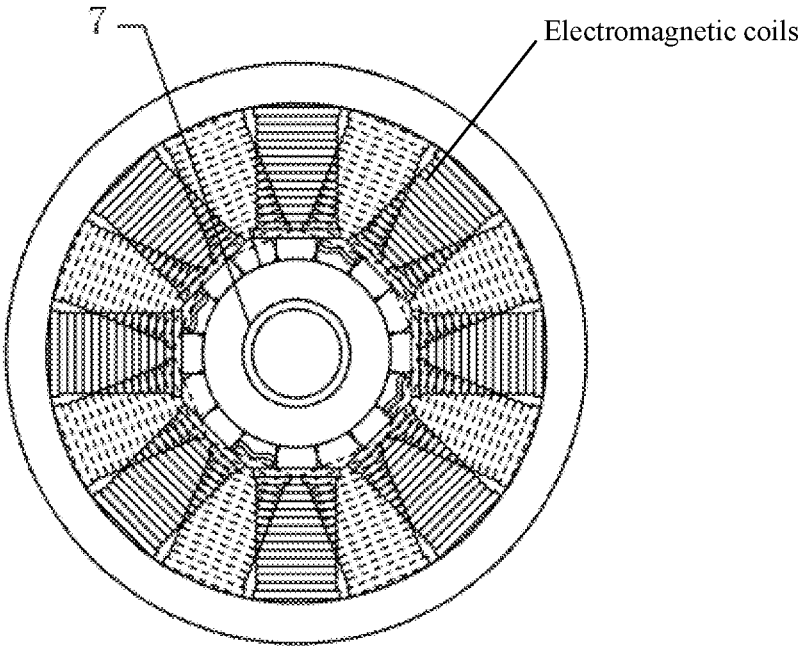
FIG. 2 is a schematic side view of a radial magnetic levitation bearing structure according to the present invention.
Figure 3:
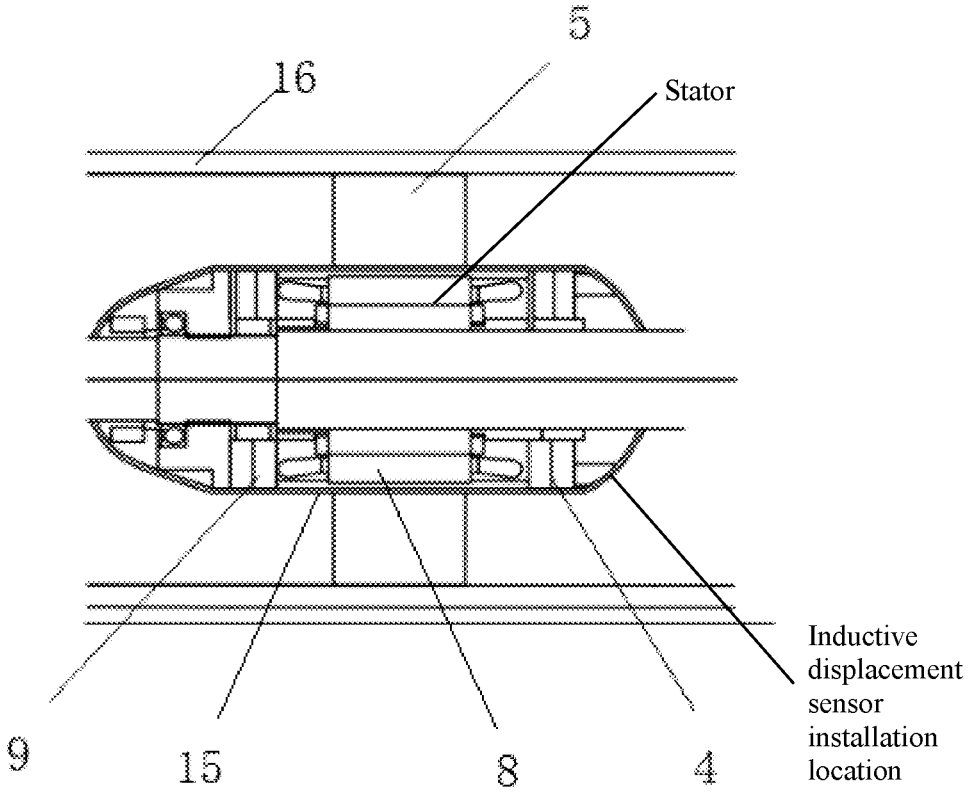
FIG. 3 is a schematic structural view of a radial magnetic levitation bearing assembly and a motor according to the present invention.
Figure 4:
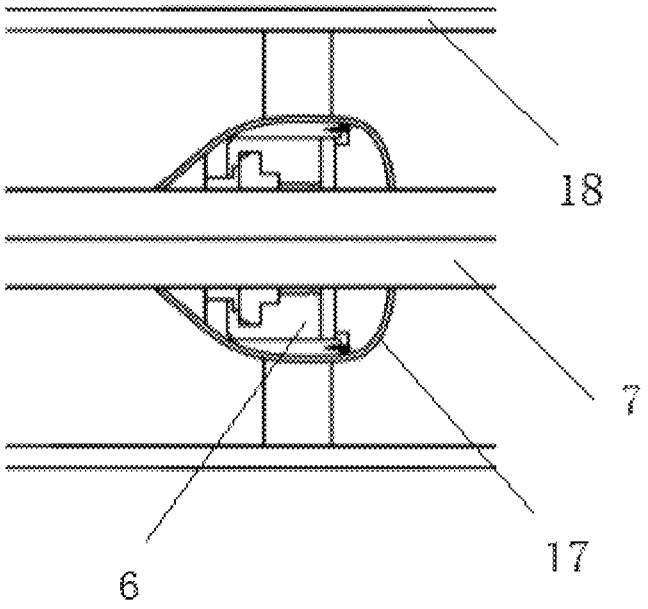
FIG. 4 is a schematic structural view of an axial magnetic levitation bearing according to the present invention.
Figure 5:
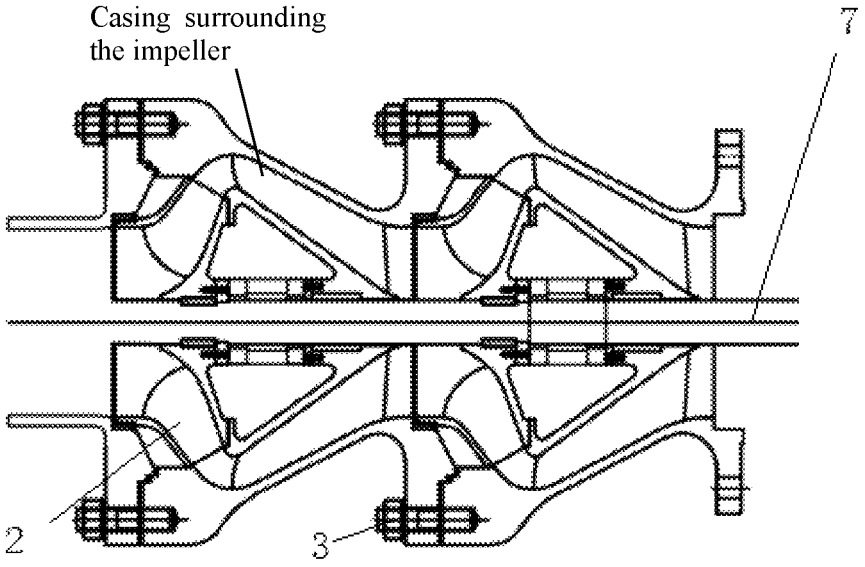
FIG. 5 is a schematic structural view of a pump stage assembly according to the present invention.

Referring to FIGS. 1-5, a scalable multi-stage magnetic levitation molten salt pump, wherein a first pump stage assembly 10, a second pump stage assembly 11, and a third pump stage assembly 12 are arranged in fluid communication sequentially between a suction interface and 13 a pressure interface 14 of the molten salt pump;

a radial magnetic levitation bearing assembly, wherein the radial magnetic levitation bearing assembly is disposed between the first pump stage assembly 10 and the second pump stage assembly 11, configured to provide rotational support to a rotor 7; and an axial magnetic levitation bearing 6, wherein the axial magnetic levitation bearing 6 is disposed between the second pump stage assembly 11 and the third pump stage assembly 12, configured to provide axial support to the rotor 7.

Wherein the radial magnetic levitation bearing assembly and the axial magnetic levitation bearing 6 are respectively encased with different streamlined bearing housings, and the streamlined bearing housings are connected to a pump body via guide vanes to form a flow channel. Prior to entering the flow channel after work is imparted by an impeller 2 of the pump stage assembly, the fluid exhibits highly nonlinear flow conditions, resulting in increased hydraulic losses. The guide vanes and the streamlined flow passage function to rectify the flow, thereby capable of eliminating a portion of the radial forces. The fluid subsequently enters the subsequent stage impeller assembly for further work input.

The present invention employs magnetic levitation bearing technology to achieve non-contact support of the rotor 7. A multi-stage impeller 2 is incorporated, being adapted for conveying high-temperature molten salt, thereby providing high efficiency and stable operational capability.

According to the present invention, by positioning the axial magnetic levitation bearing 6 between the second pump stage assembly 11 and the third pump stage assembly 12, the axial magnetic levitation bearing 6 is placed on the side with a higher axial load, more effectively counteracting the axial force generated by the fluid dynamics. Coaxially arranged electromagnetic coils generate an axial force at an end portion of the rotor 7 to prevent axial displacement or collision of the rotor 7 during high-speed rotation, thereby ensuring force equilibrium and enhancing system stability.

According to the present invention, the unique structural interaction within the flow channel formed by the different pump stage assemblies and guide vanes in conjunction with the magnetic levitation bearing housing effectively enhances hydraulic efficiency and operational stability of the unit.

The present invention separates the axial magnetic levitation bearing 6 from the radial magnetic levitation bearings, such that the configuration facilitates maintenance of the axial magnetic levitation bearing 6, reduces maintenance costs, and enhances the long-term reliability of the pump, thereby solving the technical problems in the prior art where the axial magnetic levitation bearing 6, positioned between two radial magnetic levitation bearings, is subjected to high axial loads. Furthermore, the prior art configuration, lacking separation between the axial magnetic levitation bearing 6 and radial magnetic levitation bearing, results in greater difficulty in maintenance and higher maintenance costs.

In the present invention, the first pump stage assembly 10, the second pump stage assembly 11, and the third pump stage assembly 12 each include a plurality of pump stages, the first pump stage assembly 10 and the third pump stage assembly 12 each include N pump stages, the second pump stage assembly 11 includes N pump stages, N+1 pump stages, or N+2 pump stages, each pump stage includes an impeller 2 and a casing surrounding the impeller 2, wherein the impellers 2 are all mounted on the rotor 7, and N≥1.

In specific embodiments, the pumping assembly may be expanded to multiple stages by incorporating additional impellers 2 as needed for specific application requirements. The configuration enhances the system's adaptability, allowing flexible selection of both the quantity and diameter of supplementary impellers 2 based on specific head and flow rate demands.

In specific embodiments, to accommodate the arrangement of the multi-stage impeller 2, the rotor 7 is extended accordingly, with additional or reinforced radial magnetic levitation bearings provided at corresponding positions, such that the configuration satisfies the additional mechanical requirements of the rotor 7, ensuring prevention of bending deformation or vibration induced by excessive overhang length.

The present invention features a compact structure, high scalability, stable operation, and the capability to stably convey fluids under high-temperature and highly corrosive environments, effectively overcoming the limitations inherent in traditional mechanical bearing molten salt pumps operating under harsh conditions.

In this embodiment, the radial magnetic levitation bearing assembly includes:

- a radial magnetic levitation bearing outer housing 16, wherein a first end of the radial magnetic levitation bearing outer housing is connected to a housing of the first pump stage assembly 10, and a second end is connected to a housing of the second pump stage assembly 11;
- a radial magnetic levitation bearing inner housing 15, wherein the radial magnetic levitation bearing inner housing 15 is fixedly connected to the radial magnetic levitation bearing outer housing 16 via a guide vane assembly 5;
- an electric motor 8, wherein a stator of the electric motor 8 is fixed within an interior of the radial magnetic levitation bearing inner housing 15;
- a lower radial magnetic levitation bearing 9, wherein the lower radial magnetic levitation bearing 9 is disposed within an interior of the radial magnetic levitation bearing inner housing 15 and located on a side of the electric motor 8 adjacent to the suction interface 13, and a gap is maintained between the lower radial magnetic levitation bearing 9 and the rotor 7; and
- an upper radial magnetic levitation bearing 4, wherein the upper radial magnetic levitation bearing 4 is disposed within the interior of the radial magnetic levitation bearing inner housing 15 and located on a side of the electric motor 8 distal from the suction interface 13, and a gap is maintained between the upper radial magnetic levitation bearing 4 and the rotor 7.

In this embodiment, the present invention employs two sets of radial magnetic levitation bearings to share the radial load of rotor 7.

In this embodiment, electromagnetic coils on the stator of the radial magnetic levitation bearing are arranged in two layers, wherein the electromagnetic coils of the two layers are staggered circumferentially.

In this embodiment, each layer includes an eight-pole electromagnetic coil.

The present invention enhances control over radial runout by employing a two-layer, sixteen-stage staggered arrangement of radial magnetic levitation bearings, thereby improving stability and reliability.

The present invention employs a staggered arrangement of multiple radial magnetic levitation bearings along the entire length of the rotor 7, enabling cancellation or balancing of radial forces generated by each impeller 2 at adjacent positions, enhancing operational stability across varying flow conditions, and maintaining the rotor 7 in an optimized stress state, thereby achieving increased head capacity while ensuring rotational speed stability and structural integrity.

In this embodiment, the axial magnetic levitation bearing 6 includes:

- an axial magnetic levitation bearing outer housing 18, wherein a first end of the axial magnetic levitation bearing outer housing 18 is connected to the housing of the second pump stage assembly 11, and a second end of the axial magnetic levitation bearing outer housing is connected to a housing of the third pump stage assembly 12; and
- an axial magnetic levitation bearing inner housing 17, wherein the axial magnetic levitation bearing inner housing 17 is fixedly connected to the radial magnetic levitation bearing outer housing 18 via a guide vane assembly 5, and a gap is maintained between the axial magnetic levitation bearing inner housing 17 and the rotor 7.

In specific embodiments, the electromagnetic coil incorporates multilayer insulation and high thermal conductivity materials, with cooling channels integrated when required.

In this embodiment, the molten salt pump is configured to withstand high-temperatures and high-speed operation. To this end, high-performance electromagnetic materials and a high-reliability control system are employed, to ensure stable operation even under high-temperature and high-load conditions.

In specific embodiments, the housing surrounding the impeller 2, the radial magnetic levitation bearing outer housing 16, and the axial magnetic levitation bearing outer housing 18 are formed from a high-temperature-resistant metal material or a high-corrosion-resistant alloy to satisfy chemical compatibility and mechanical strength requirements for high-temperature fluids such as molten salt, and adjacent housings are coupled together via connecting bolts 3.

In this embodiment, inductive displacement sensors are respectively disposed in the gap between the lower radial magnetic levitation bearing 9 and rotor 7, the gap between the upper radial magnetic levitation bearing 4 and rotor 7, and the gap between the axial magnetic levitation bearing inner housing 17 and rotor 7.

In specific embodiments, to improve control precision over vibration and positional changes of rotor 7, a displacement sensor assembly is utilized to monitor offset of rotor 7 in each radial direction.

In specific embodiments, real-time offset data of rotor 7 is obtained by processing input from an inductive displacement sensor at high speed; then the corresponding control commands are calculated by the displacement controller and output to the amplifier system, where the power signal is converted into the control current required by the magnetic levitation bearing; and the magnetic field intensity within rotor 7 is adjusted by varying the electric current supplied to the electromagnetic coil, whereby the magnitude and direction of the radial electromagnetic force are modified, enabling enhanced precision in active control, wherein both the magnetic field intensity within rotor 7 and the resultant radial electromagnetic force are precisely regulated.

In this embodiment, the suction interface 13 is provided with an inlet filter screen 1 to prevent impurities from entering and protect the pump body from damage.

The foregoing description merely illustrates preferred embodiments of the present invention and is not intended to limit the scope of the technology in any way. Any modifications, equivalent variations, and refinements made based on the technical essence of the present invention to the above embodiments shall still fall within the scope of the technical solutions of the present invention.

What is claimed is:

1. A scalable multi-stage magnetic levitation molten salt pump, comprising: a first pump stage assembly, a second pump stage assembly, and a third pump stage assembly, which are arranged in fluid communication sequentially between a suction interface and a pressure interface of the molten salt pump;

a radial magnetic levitation bearing assembly, wherein the radial magnetic levitation bearing assembly is disposed between the first pump stage assembly and the second pump stage assembly, configured to provide rotational support to a rotor;

an axial magnetic levitation bearing, wherein the axial magnetic levitation bearing is disposed between the second pump stage assembly and the third pump stage assembly, configured to provide axial support to the rotor;

wherein the radial magnetic levitation bearing assembly and the axial magnetic levitation bearing are respectively enclosed by separate streamlined bearing housings, the streamlined bearing housings are connected to a pump body via guide vanes to form a flow channel;

the radial magnetic levitation bearing assembly comprises:

a radial magnetic levitation bearing outer housing, wherein a first end of the radial magnetic levitation bearing outer housing is connected to a housing of the first pump stage assembly, and a second end is connected to a housing of the second pump stage assembly;

a radial magnetic levitation bearing inner housing, wherein the radial magnetic levitation bearing inner housing is a streamlined bearing housing, and the radial magnetic levitation bearing inner housing is fixedly connected to the radial magnetic levitation bearing outer housing via a guide vane assembly;

an electric motor, wherein a stator of the electric motor is fixed within an interior of the radial magnetic levitation bearing inner housing;

a lower radial magnetic levitation bearing, wherein the lower radial magnetic levitation bearing is disposed within the interior of the radial magnetic levitation bearing inner housing and located on a side of the electric motor adjacent to the suction interface, and a gap is maintained between the lower radial magnetic levitation bearing and the rotor; and an upper radial magnetic levitation bearing, wherein the upper radial magnetic levitation bearing is disposed within the interior of the radial magnetic levitation bearing inner housing and located on a side of the electric motor distal from the lower radial magnetic levitation bearing, and a gap is maintained between the upper radial magnetic levitation bearing and the rotor.

2. The scalable multi-stage magnetic levitation molten salt pump according to claim 1, wherein the first pump stage assembly, the second pump stage assembly, and the third pump stage assembly each comprise a plurality of pump stages, the first pump stage assembly and the third pump stage assembly each comprise N pump stages, the second pump stage assembly comprises N pump stages, N+1 pump stages, or N+2 pump stages, each pump stage comprises an impeller and a casing surrounding the impeller, wherein the impellers are mounted on the rotor, and $N \geq 1$.

3. The scalable multi-stage magnetic levitation molten salt pump according to claim 1, wherein electromagnetic coils on the stator of the radial magnetic levitation bearing are arranged in two layers, wherein the electromagnetic coils of the two layers are staggered circumferentially.

4. The scalable multi-stage magnetic levitation molten salt pump according to claim 3, wherein each layer comprises an eight-pole electromagnetic coil.

5. The scalable multi-stage magnetic levitation molten salt pump according to claim 1, wherein the axial magnetic levitation bearing comprises:

an axial magnetic levitation bearing outer housing, wherein a first end of the axial magnetic levitation bearing outer housing is connected to the housing of the second pump stage assembly, and a second end of the axial magnetic levitation bearing outer housing is connected to a housing of the third pump stage assembly; and an axial magnetic levitation bearing inner housing, wherein the radial magnetic levitation bearing inner housing is a streamlined bearing housing, the axial magnetic levitation bearing inner housing is fixedly connected to the radial magnetic levitation bearing outer housing via a guide vane assembly, and a gap is maintained between the axial magnetic levitation bearing inner housing and the rotor.

6. The scalable multi-stage magnetic levitation molten salt pump according to claim 5, wherein an inductive displacement sensor is disposed in each of the gap between the lower radial magnetic levitation bearing and the rotor, the gap between the upper radial magnetic levitation bearing and the rotor, and the gap between the axial magnetic levitation bearing inner housing and the rotor.

7. The scalable multi-stage magnetic levitation molten salt pump according to claim 1, wherein the suction interface is provided with an inlet filter screen.

* * * * *